US011871844B2

(12) United States Patent
Yoon et al.

(10) Patent No.: US 11,871,844 B2
(45) Date of Patent: Jan. 16, 2024

(54) REINFORCEMENT BEAM FOR HORIZONTAL FRAMES AND PREFABRICATED SHELF USING SAME

(71) Applicant: Speedrack Co., Ltd., Gimpo-si (KR)

(72) Inventors: Hyo Sang Yoon, Gimpo-si (KR); Yoon Ki Kim, Gimpo-si (KR); Jae Koon Han, Gimpo-si (KR); Jun Hyuk Lee, Seoul (KR)

(73) Assignee: SPEEDRACK CO., LTD., Gimpo-si (KR)

( * ) Notice: Subject to any disclaimer, the term of this patent is extended or adjusted under 35 U.S.C. 154(b) by 0 days.

(21) Appl. No.: 17/559,207

(22) Filed: Dec. 22, 2021

(65) Prior Publication Data

US 2023/0044061 A1 Feb. 9, 2023

(30) Foreign Application Priority Data

Aug. 5, 2021 (KR) ..... 10-2021-0103084

(51) Int. Cl.
*A47B 47/00* (2006.01)
*A47B 96/14* (2006.01)

(52) U.S. Cl.
CPC ..... *A47B 47/0041* (2013.01); *A47B 47/0083* (2013.01); *A47B 96/1441* (2013.01)

(58) Field of Classification Search
CPC ..... A47B 47/0041; A47B 47/0083; A47B 96/1441
USPC ..... 312/107
See application file for complete search history.

(56) References Cited

U.S. PATENT DOCUMENTS 4,062,164 A * 12/1977 Cousins ..... E04B 9/247 52/506.07
4,078,664 A * 3/1978 McConnell ..... A47B 96/00 211/187
4,285,436 A * 8/1981 Konstant ..... A47B 57/482 211/192
5,279,431 A * 1/1994 Highsmith ..... B65G 1/02 211/187

(Continued)

FOREIGN PATENT DOCUMENTS

JP S55032501 Y 8/1980
JP S56163938 U 12/1981

(Continued)

*Primary Examiner* — Daniel J Troy
*Assistant Examiner* — Timothy M Ayres
(74) *Attorney, Agent, or Firm* — CANTOR COLBURN LLP

(57) ABSTRACT

Provided is a reinforcement beam for horizontal frames, the reinforcement beam being configured to be used in a prefabricated shelf that is fabricated with vertical frames and horizontal frames, the horizontal frames including a connection portion fastened to the vertical frames at end portions of the connection portion, and an abutment portion which is formed by folding the connection portion such that the abutment portion is formed integrally with the connection portion and which supports a support plate. The reinforcement beam for the horizontal frames includes a body portion in which a pulling portion configured to support a lower outer surface of the connection portion is provided on each of opposite ends of the body portion. The reinforcement beam for the horizontal frames prevents the horizontal frames from collapsing under a large load.

4 Claims, 7 Drawing Sheets

(56) References Cited

U.S. PATENT DOCUMENTS

| | | | | |
|---|---|---|---|---|
| 9,215,926 | B1 * | 12/2015 | Offerman | A47B 47/02 |
| 9,215,931 | B1 * | 12/2015 | Offerman | A47B 96/024 |
| 10,299,594 | B2 * | 5/2019 | Liss | A47B 47/027 |
| 10,806,257 | B1 * | 10/2020 | Liu | A47B 47/024 |
| 11,026,509 | B2 * | 6/2021 | Walker | A47B 47/027 |
| 2015/0359330 | A1 | 12/2015 | Offerman | |
| 2019/0328134 | A1 | 10/2019 | Walker | |

FOREIGN PATENT DOCUMENTS

| | | | |
|---|---|---|---|
| JP | 63014702 | | 1/1988 |
| JP | 2001112590 | A | 4/2001 |
| KR | 200228609 | | 6/2001 |
| KR | 200246071 | | 11/2001 |
| KR | 101845802 | | 4/2018 |

* cited by examiner

REINFORCEMENT BEAM FOR HORIZONTAL FRAMES AND PREFABRICATED SHELF USING SAME

BACKGROUND OF THE INVENTION

Field of the Invention

The present disclosure relates to a reinforcement beam for horizontal frames, the reinforcement beam being configured to prevent the horizontal frames from collapsing under a large load, and relates to a prefabricated shelf using the reinforcement beam for the horizontal frames.

Description of the Related Art

When a display cabinet, a storage closet, a showcase, and the like are manufactured by using a prefabricated angle instead of wood, there are many advantages such as relatively low price, excellent rigidity, convenience of assembling, disassembly when moving, adjustability of a shelf height, and so on.

In Korean Patent No. 10-1845802 (Assembly shelf), a structure in which a protruding portion of a horizontal frame is forcibly fitted to a fastening hole of a vertical frame is disclosed. In the vertical frame, two supporting portions are formed perpendicular to each other. In the horizontal frame, an abutment portion for supporting a support plate and a connection portion connected to the vertical frame are formed perpendicular to each other. The horizontal frame is fastened to the vertical frame, and the support plate is placed on the abutment portion of the horizontal frame, and then an object is placed on the support plate. Since a large load is applied to the horizontal frame when a heavy object is placed on the support plate, a reinforcement beam for connecting the facing horizontal frames to each other may be mounted so as to distribute the load. However, since an existing reinforcement beam is mounted in a manner that the existing reinforcement beam is placed on an upper portion of the horizontal frame, a high load is applied to the reinforcement beam when an object placed on the support plate is very heavy, and the reinforcement beam pulls the upper portion of the horizontal frame inward, so that there is a problem that a lower portion of the horizontal frame is bent outward and the horizontal frame collapses.

Document of Related Art (Utility Model Document 1) Korean Utility Model No. 20-0228609 (Frame angle board consolidation structure)

(Utility Model Document 2) Korean Utility Model No. 20-0246071 (Prefabricated angle)

(Patent Document 1) Korean Patent No. 10-1845802 (Assembly shelf)

SUMMARY OF THE INVENTION

Accordingly, an objective of the present disclosure is to provide a reinforcement beam for horizontal frames, the reinforcement beam being configured to prevent the horizontal frames from collapsing even under a large load.

In addition, another objective of the present disclosure is to provide a prefabricated shelf capable of supporting a large load.

In order to achieve the above objectives, according to one aspect of the present disclosure, there is provided a reinforcement beam for horizontal frames, the reinforcement beam being configured to be used in a prefabricated shelf that is fabricated with vertical frames and horizontal frames, the horizontal frames including a connection portion fastened to the vertical frames at end portions of the connection portion, and an abutment portion which is formed by folding the connection portion such that the abutment portion is formed integrally with the connection portion and which supports a support plate, the reinforcement beam including a body portion in which a pulling portion configured to support a lower outer surface of the connection portion is provided on each of opposite ends of the body portion.

Preferably, the body portion may be configured to support an inner surface of the connection portion. In addition, a locking portion may be provided on each of the opposite ends of the body portion to be caught on the abutment portion. The locking portion may be provided with an embossed reinforcement portion.

Preferably, the body portion may include: a first horizontal member in which the pulling portion is formed on each of opposite ends of the first horizontal member; a vertical member formed integrally with the first horizontal member and configured to support the inner surface of the connection portion; and a second horizontal member formed integrally with the vertical member and in which the locking portion configured to be caught on the abutment portion is formed on each of opposite ends of the second horizontal member. The first horizontal member and the second horizontal member may be formed by being folded in opposite directions to each other with respect to the vertical member.

In addition, according to another aspect of the present disclosure, there is provided a prefabricated shelf including: vertical frames; horizontal frames including a connection portion fastened to the vertical frames at end portions of the connection portion, and an abutment portion which is formed by folding the connection portion such that the abutment portion is formed integrally with the connection portion and which supports a support plate; and a reinforcement beam configured to reinforce the horizontal frames, the reinforcement beam being provided with a body portion in which a pulling portion configured to support a lower outer surface of the connection portion is provided on each of opposite ends of the body portion.

According to the reinforcement beam for the horizontal frames of the present disclosure as described above, when a heavy object is placed on the prefabricated shelf, it is possible to prevent the horizontal frames from collapsing even under a large load that is twice as heavy as an object that may be supported on a conventional prefabricated shelf.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
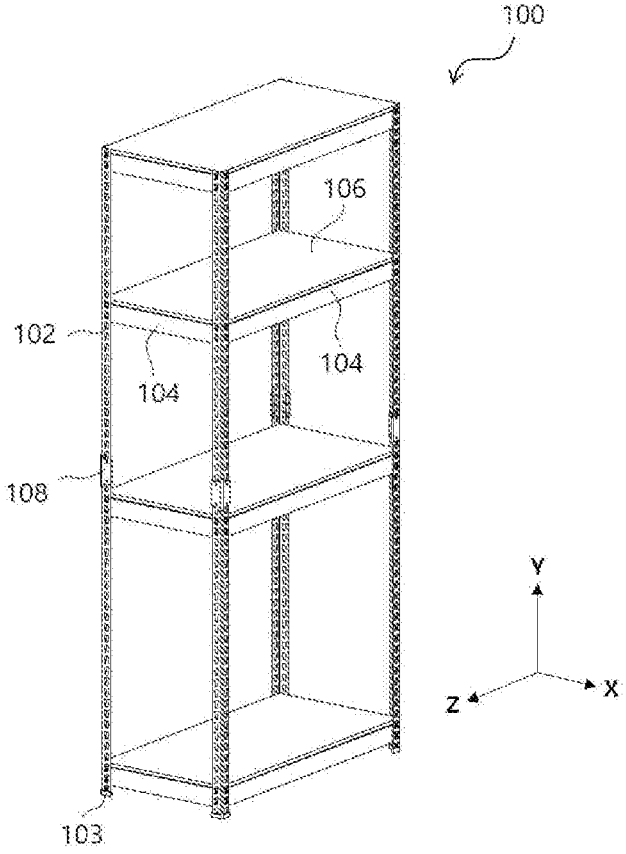
FIG. 1 is a view illustrating a configuration of a prefabricated shelf to which a reinforcement beam for horizontal frames of the present disclosure is applied.

Hereinafter, an embodiment of the present disclosure will be described in detail with reference to the accompanying drawings.

In the accompanying drawings, the same or similar elements are denoted by the same reference numerals. In the drawings, the size or the thickness of each of the elements is exaggerated for ease of understanding. However, the scope of the present disclosure should not be interpreted as being limited thereto.

Figure 2:
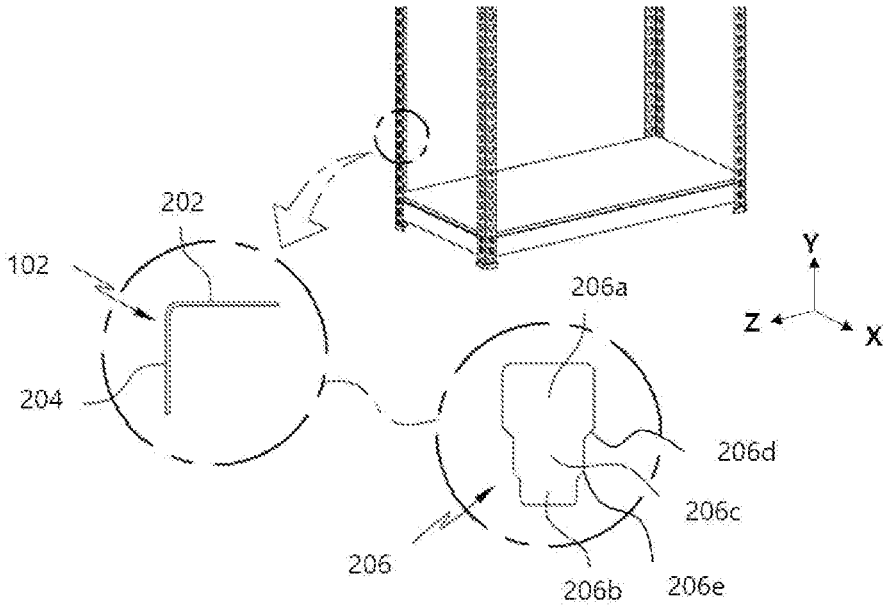
FIG. 2 is a view illustrating a structure of vertical frames illustrated in FIG. 1.

FIG. 1 is a view illustrating a configuration of a prefabricated shelf 100 to which a reinforcement beam for horizontal frames is applied, and FIG. 2 is a view illustrating a structure of vertical frames 102 that are illustrated in FIG. 1. As illustrated in the drawings, the prefabricated shelf 100 includes the vertical frames 102, the horizontal frames 104, and a support plate 106. The vertical frame 102 is formed of two support portions 202 and 204 that are connected perpendicularly to each other, and the support portions 202 and 204 are provided with a plurality of fastening holes 206.

The plurality of fastening holes 206 is provided in the support portions 202 and 204 at regular intervals such that an assembled height of the horizontal frames 104 is capable of being adjusted, and may be arranged in one row or multiple rows along in a longitudinal direction (or a Y direction) of the vertical frame 102. An upper hole 206*a*, a middle hole 206*c*, and a lower hole 206*b* are sequentially formed in each of the fastening holes 206 in the longitudinal direction. A width of the middle hole 206*c* is narrower than a width of the upper hole 206*a*, and the middle hole 206*c* is in communication with the upper hole 206*a* via a first inclined portion 206*d*. A width of the lower hole 206*b* is narrower than the width of the middle hole 206*c*, and the lower hole 206*b* is in communication with the middle hole 206*c* via a second inclined portion 206*e*.

Each of the vertical frames 102 is fitted with respective backing members 103 that are respectively provided with a receiving groove formed in an 'L' shape, and is provided vertically on each of the backing members 103, so that pillars of a shelf are formed. In addition, the vertical frames 102 are formed of a plurality of unit partial bodies having a predetermined length such that an overall height of the shelf can be changed. At this time, a bracket 108 is used in order to extend and connect at least two vertical frames 102.

Figure 3:
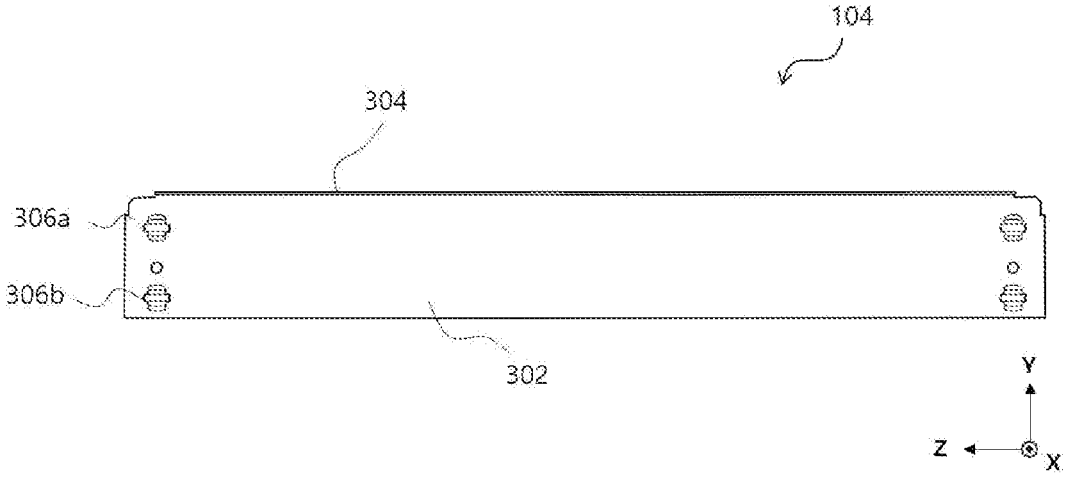
FIG. 3 is a view illustrating a structure of the horizontal frames illustrated in FIG. 1.
Figure 4:
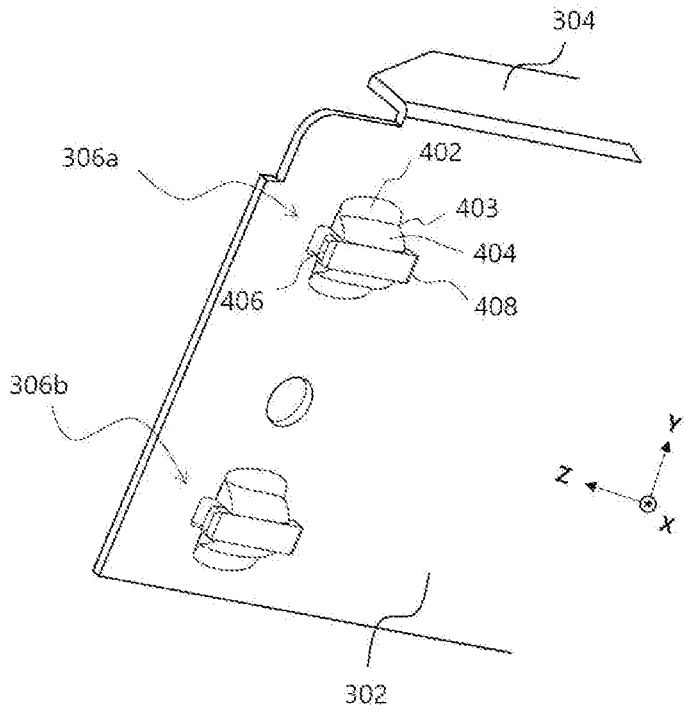
FIG. 4 is a detailed view illustrating fastening protrusions illustrated in FIG. 3.

FIG. 3 is a view illustrating a structure of the horizontal frame 104 that are illustrated in FIG. 1. As illustrated in the drawings, the horizontal frame 104 includes a connection portion 302, an abutment portion 304, and fastening protrusions 306*a* and 306*b*. FIG. 4 is a detailed view illustrating the fastening protrusions 306*a* and 306*b* that are illustrated in FIG. 3.

The abutment portion 304 is formed in a shape in which a corner of the connection portion 302 along a longitudinal direction (a Z direction) is folded approximately at a right angle by a predetermined width, and supports the support plate 106.

The connection portion 302 is provided with the fastening protrusions 306*a* and 306*b* that are formed in line on an outer surface of end portions of the connection portion 302. A distance between the fastening protrusions 306*a* and 306*b* is equal to a distance between the two fastening holes 206 that are formed in the vertical frames 102. The fastening protrusions 306*a* and 306*b* are protrudingly formed on the outer surface (or front surface) of both a first end and a second end of the connection portion 302. Between two vertical frames 102 that form the pillars, fastening protrusions 306*a* and 306*b* of both the first end and second end of the horizontal frame 104 are fastened to the fastening holes 206 at the same height. Since the fastening protrusions 306*a* and 306*b* are fastened to the fastening holes 206 from an inner sides of the vertical frames 102, the front surface of the horizontal frame 102 is in contact with rear surfaces of the vertical frames 102. Therefore, the size of protruding portions for fastening the horizontal frame 104 to the vertical frames 102 is minimized, so that an excellent aesthetic appearance of the shelf may be realized.

As illustrated FIG. 4, each of the fastening protrusions 306*a* and 306*b* is provided with a lower convex portion 402 and an upper convex portion 404 that are protruding in a thickness direction (an X direction) and that are having inclined surfaces inclined in a width direction (a Y direction), and is provided with wing portions 406 and 408 that protrude toward a longitudinal direction (a Z direction) from side surfaces of the upper convex portion 404. Between the lower convex portion 402 and the upper convex portion 404, a curved portion 403 having a discontinuous inclined surface is formed.

Figure 5A:
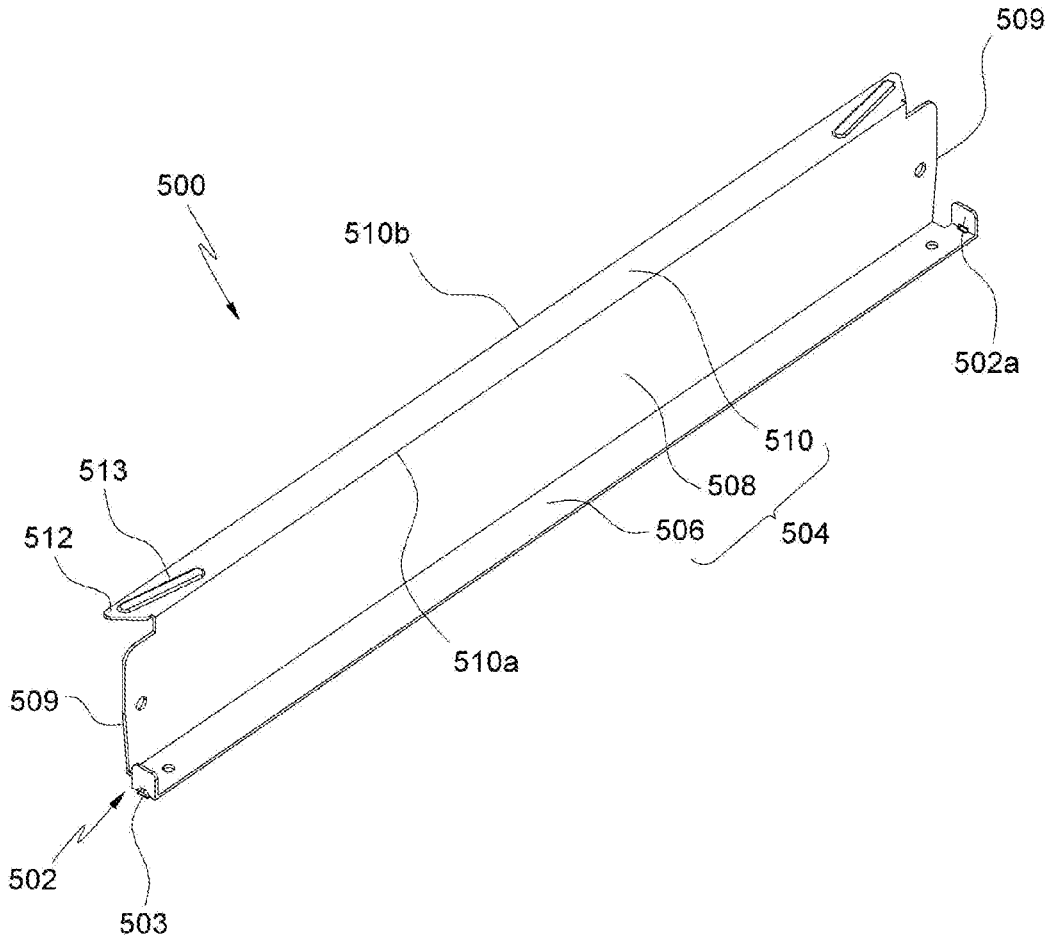
FIGS. 5A to 5C are views illustrating a configuration of the reinforcement beam for the horizontal frames according to an embodiment of the present disclosure.
Figure 5B:
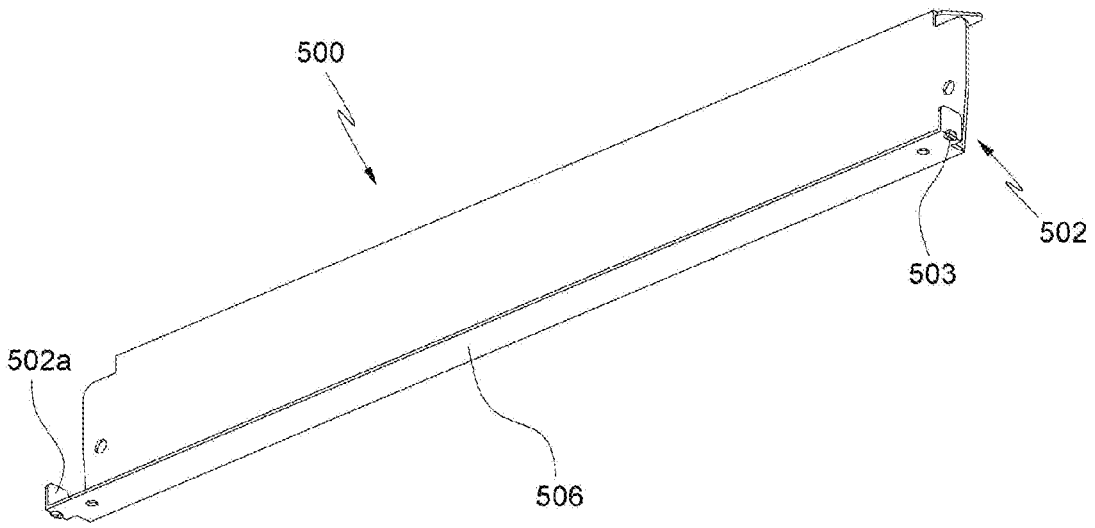
Figure 5C:
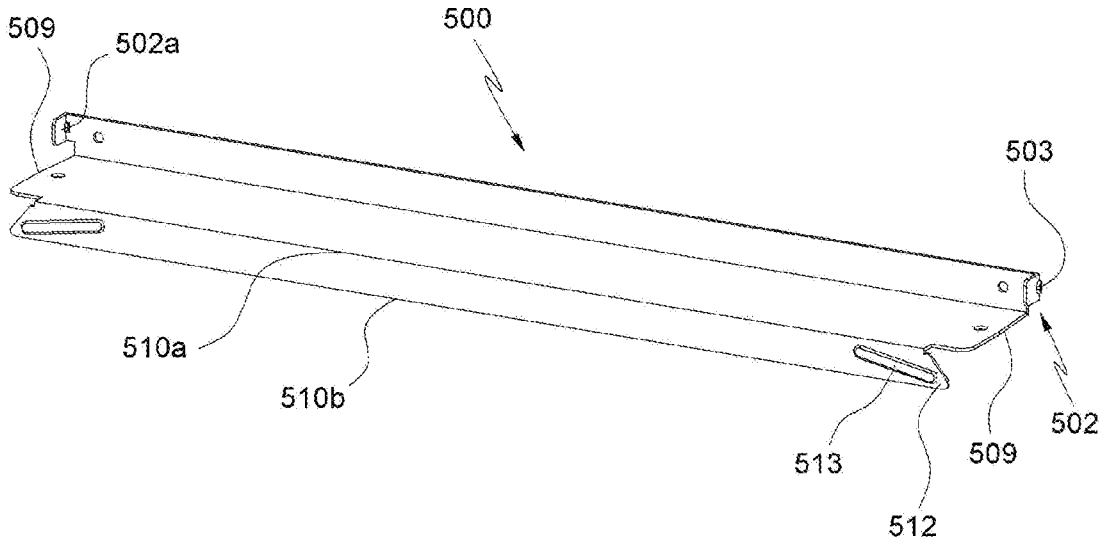
Figure 6:
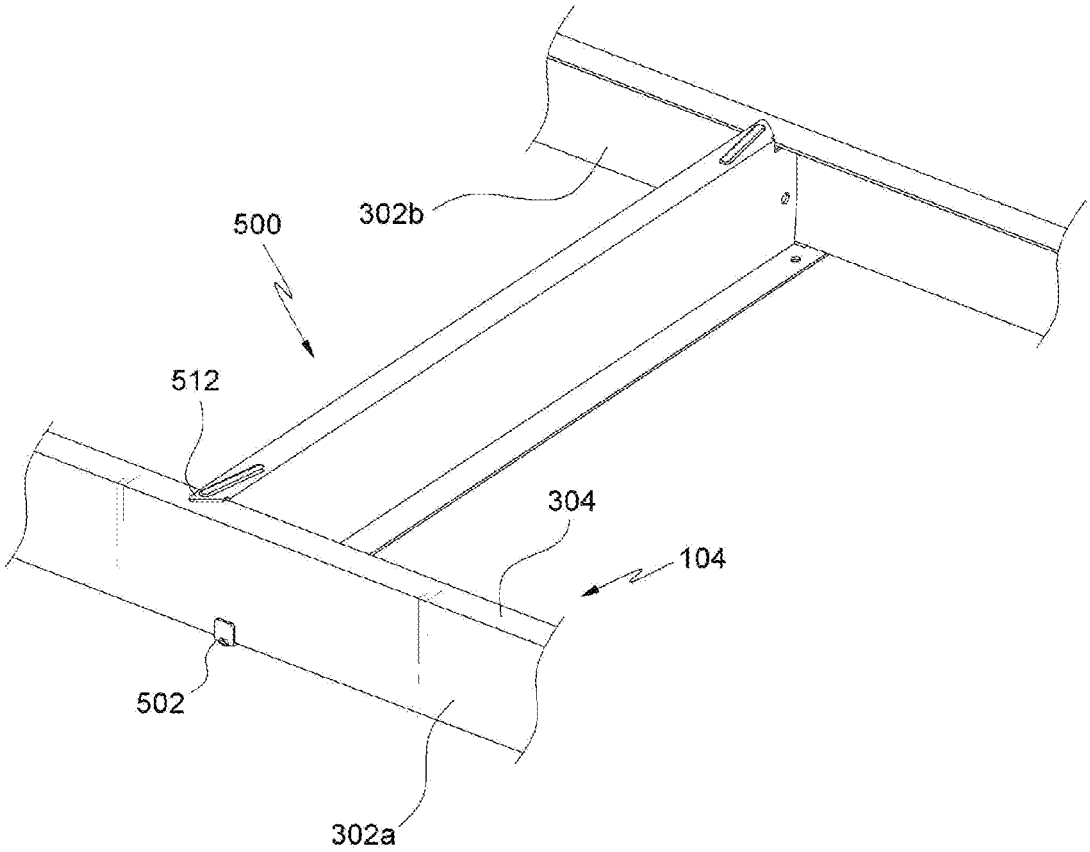
FIG. 6 is a view illustrating a state in which the reinforcement beam for the horizontal frames illustrated in FIGS. 5A to 5C is mounted between the horizontal frames.

FIGS. 5A to 5C are views illustrating a configuration of a reinforcement beam 500 for horizontal frames, and FIG. 6 is a view illustrating a state in which the reinforcement beam 500 for the horizontal frames are mounted between the horizontal frames 104. As illustrated in the drawings, each of opposite end portions of a body portion 504 of the reinforcement beam 500 for the horizontal frames is provided with a pulling portion 502.

As illustrated in FIG. 6, the pulling portion 502 supports a lower outer surface 302*a* of the connection portion 302 of the horizontal frame 104, and prevents the lower portion of the connection portion 302 from being bent outward.

The body portion 504 is provided with a first horizontal member 506, a vertical member 508, and a second horizontal member 510. The first horizontal member 506, the vertical member 508, and the second horizontal member 510 are formed integrally with each other. A border between the first horizontal member 506 and the vertical member 508 and a border between the vertical member 508 and the second horizontal member 510 are folded approximately at a right angle by performing a bending, respectively. The first horizontal member 506 and the second horizontal member 510 are folded in the opposite direction to each other with respect to the vertical member 508. These orientations of the first and second horizontal frames 506 and 510 facilitate the fastening of the reinforcement beam 500 for the horizontal frames to the horizontal frames 104.

Opposite ends of the first horizontal member 506 in the longitudinal direction are folded approximately at a right angle toward the vertical member 508, so that the pulling portions 502 are formed. A first embossed reinforcement portion 503 is formed on each of the pulling portions 502.

Side surface support portions 509 formed on opposite ends of the vertical member 508 in a longitudinal direction support an inner side surface 302*b* of the connection portion 302. A gap capable of accommodating the connection portion 302 of the horizontal frame 104 is formed between the side surface support portion 509 and an internal side surface 502*a* of the pulling portion 502. The side surface support portion 509 of the vertical member 508 is formed such that a height thereof is lower than a height of the border between the vertical member 608 and the second horizontal member 510, so that a gap capable of accommodating the abutment portion 304 of the horizontal frame 104 is provided.

A locking portion 512 caught on the abutment portion 304 is formed on each of opposite ends of the second horizontal member 510 in a longitudinal direction. A second embossed reinforcement portion 513 is formed on each of the locking portions 512.

The locking portion 512 is formed in an inclined shape so that a length of a border portion 510*a* between the vertical member 508 and the second horizontal member 510 is shorter than a length of an opposite side end portion 510*b*. This shape of the locking portion 512 enables the reinforcement beam 500 to be easily mounted between the horizontal frames 104.

The embodiments described above are intended to facilitate the understanding of the present disclosure to those skilled in the art, and the scope of the present disclosure is not limited thereto. Therefore, it is obvious to those skilled in the art that various modifications and changes may be derived within the scope of the present disclosure.

What is claimed is:

1. A reinforcement beam for a prefabricated shelf having vertical frames and horizontal frames, the horizontal frames having a connection portion fastened to the vertical frames at end portions of the connection portion, and an abutment portion formed integrally with the connection portion and supporting a support plate, the connection portion having an outer side surface and an inner side surface substantially vertical to the abutment portion, the reinforcement beam comprising:

a first horizontal member;

a second horizontal member;

a vertical member formed between the first horizontal member and the second horizontal member and integrally with the first horizontal member and the second horizontal member;

a locking portion formed on each of opposite ends of the second horizontal member and configured to be caught on the abutment portion of the horizontal frames, the locking portion being formed in an inclined shape so that a length of a border portion between the vertical member and the second horizontal member is shorter than a length of the second horizontal member for the locking portion to be placed on an upper surface of the abutment portion of the connection portion;

a pulling portion formed on each of opposite ends of the first horizontal member, wherein the pulling portion is bent upward in a direction toward the locking portion substantially at a right angle, and configured to contact and support a lower outer side surface of the connection portion; and a side surface support portion formed on each of opposite ends of the vertical member in a longitudinal direction of the vertical member and configured to contact and support an inner side surface of the connection portion under the abutment portion thereof with the locking portion placed on the upper surface of the abutment portion.

2. The reinforcement beam of claim 1, wherein the locking portion is provided with an embossed reinforcement portion.

3. The reinforcement beam of claim 1, wherein the first horizontal member and the second horizontal member form a right angle with the vertical member in opposite directions to each other with respect to the vertical member.

4. A prefabricated shelf comprising:

a vertical frame;

a horizontal frame having a connection portion fastened to the vertical frames at end portions of the connection portion and an abutment portion formed integrally with the connection portion and supporting a support plate; and a reinforcement beam according to claim 1.

* * * * *